United States Patent [19]

Smith

[11] Patent Number: 4,658,447

[45] Date of Patent: Apr. 21, 1987

[54] TOILETTE SEAT LOCK

[76] Inventor: Mark A. Smith, 1330 E. Banyan Ave., Anaheim, Calif. 92805

[21] Appl. No.: 748,055

[22] Filed: Jun. 24, 1985

[51] Int. Cl.[4] ..... A47K 13/12

[52] U.S. Cl. ..... 4/236; 4/253; 16/329

[58] Field of Search ..... 4/236, 240, 253; 16/324, 326, 328, 329, 348, 349, 327, 319, 321, 324, 330–332

[56] References Cited

U.S. PATENT DOCUMENTS

| | | | |
|---|---|---|---|
| 294,746 | 3/1884 | Straup et al. | 16/330 |
| 385,138 | 6/1888 | Reinisch | 16/329 |
| 853,507 | 5/1907 | Fielding | 16/329 |
| 2,240,220 | 4/1941 | Leslie | 4/236 |
| 2,268,713 | 1/1942 | Lutt | 16/328 |
| 2,431,263 | 11/1947 | Lundgren | 4/236 |
| 2,462,268 | 2/1949 | Kahl | 16/328 |
| 2,578,153 | 12/1951 | Schmitz | 4/253 |
| 3,157,433 | 11/1964 | Davis | 16/327 |
| 4,403,373 | 9/1983 | Kümmerlin | 16/326 |

*Primary Examiner*—Stephen Marcus
*Assistant Examiner*—Linda J. Sholl
*Attorney, Agent, or Firm*—John H. Lynn

[57] ABSTRACT

A locking shaft extends through passages in a mounting bracket, a seat bracket and a seat cover bracket to prevent small children from raising the seat and seat cover. The locking shaft and a plunger are mounted to an end cap with the plunger being slidable within an axial passage in a rod upon which the brackets are mounted. A spring connected to the plunger inside the axial passage biases the locking shaft toward a locked position. In order to unlock the seat and seat cover, a person must pull the locking shaft out of the passages in the seat bracket and the seat cover bracket and raise the eat and seat cover, or just the seat cover if so desired, after placing the locking shaft in the unlocked position.

1 Claim, 5 Drawing Figures

TOILETTE SEAT LOCK

BACKGROUND OF THE INVENTION

This invention relates generally to locking devices for toilette seats and seat covers and particularly to a locking device for preventing small children from raising a toilette seat or a toilette seat cover.

Some small children that are capable of standing upright are capable of raising a toilette seat and its cover without supervision from a responsible person. The ability of small children to raise toilette seats and toilette seat covers presents significant safety and sanitary problems in many homes. Children have climbed into toilette bowls and then have been unable to extricate themseles from the bowl after the seat or lid has fallen upon them. A child who places his head between the raised seat and the toilette bowl may be seriously injured if the seat should fall upon him. Some children have died from accident resulting from their ability to raise the toilette seat or even just the seat cover. Head and neck injuries and even drowning are often the result of an unattended child's curiosity about the toilet.

It is impractical to provide an active child with constant supervision and monitoring of his activities. Therefore, there is a need for a simple, inexpensive, easy to install device for preventing a small child from gaining access to a toilette bowl by raising either the seat and seat cover or just the seat cover alone.

SUMMARY OF THE INVENTION

The present invention provides a lock for a toilette seat that prevents small children from raising a toilette seat or seat cover. A seat lock according to the invention is easy to install, has few mechanical components and is relatively inexpensive to manufacture. The device requires the use of two hands in order to release the lock and raise the seat or lid and; therefore, is difficult for a small child to open, but easy for a larger child or an adult to open.

The toilette seat lock includes a hollow rod upon which three pairs of brackets are mounted. The first pair of brackets are designed to align with seat mounting holes that are present at the rear portion of a typical toilette bowl. Te second pair of brackets are rotatable upon the rod and configured for having a toilette seat lid affixed thereto. The third pair of brackets is also rotatable upon the rod and is configured for mounting a toilette seat.

A spring is mounted inside the hollow rod with one end fastened to be stationary relative to the rod. The other end of the spring is connected to an inner end of a plunger that is slidable inside the rod. When the seat and seat cover are locked in the closed positions, the plunger is positioned within the hollow rod with an outer end of the plunger being flush with an open end of the rod. The spring biases the plunger to retain it inside the rod in the absence of an externally applied axial force urging the plunger out of the rod. The range of linear motion of the plunger in the rod is limited to prevent the locking device from inadvertant disassembly.

A knob configured for grasping by a person is attached to an outer end of the plunger to facilitate release of a locking mechanism that includes one of each of the three pairs of brackets and a locking shaft that is attached to the knob. The brackets mounted at the end of the rod where the plunger is located each have a locking passage therein for selectively receiving the locking shaft. The plunger is retained against rotational movement inside the rod to prevent rotation of the seat bracket and the seat cover bracket relative to the rod, thereby locking them in the closed position. The locking passages are spaced apart from and generally parallel to holes in the brackets that mount brackets upon the hollow rod.

A person desiring to raise the seat cover pulls the knob outward to remove the locking shaft from the locking passage in the seat cover bracket while exerting an upward force on the seat cover. If both the seat and the seat cover are to be raised, the knob is pulled outward to remove the locking shaft from the locking passages while an upward force is exerted on the seat, which is under the seat cover, to rotate the locking passages out of alignment with the locking shaft. When the seat and seat cover are rotated to the closed position, the bias of the spring urges the plunger inward into the hollow rod thereby moving the locking shaft into the locking passages to prevent small children from raising the seat and seat cover.

DESCRIPTION OF THE PREFERRED EMBODIMENT

Figure 1:
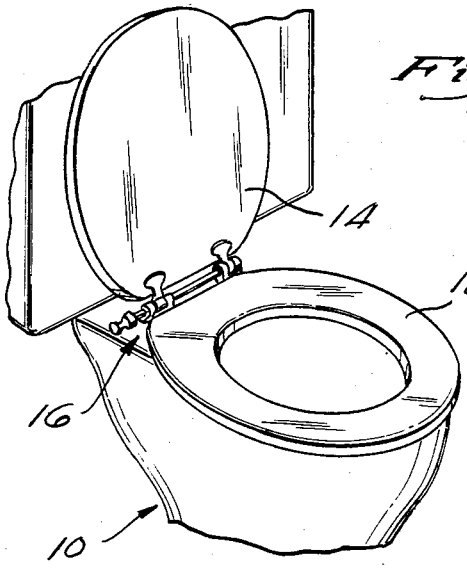
FIG. 1 is a perspective view showing a toilette seat lock according to the invention attached to a toilette to mount a seat and seat cover thereto.
Figure 2:
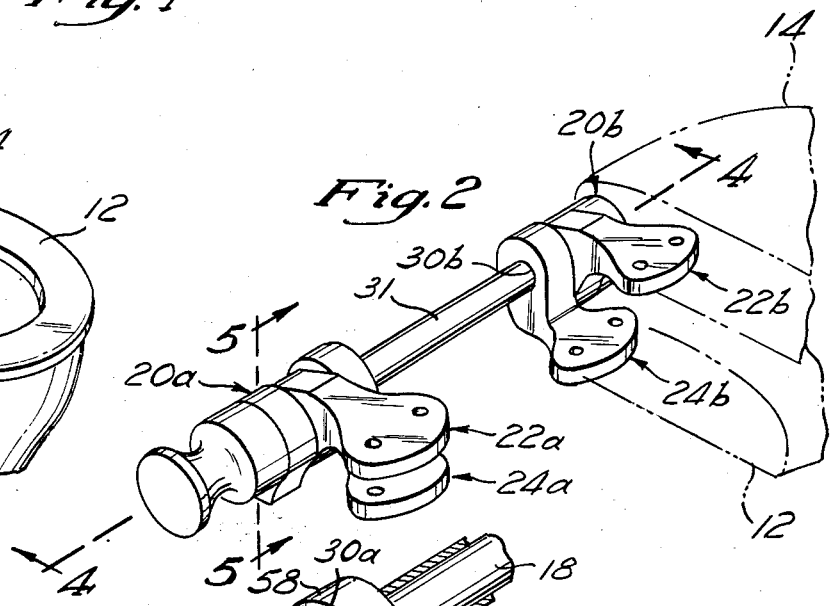
FIG. 2 is a perspective view of the toilette seat lock according to the invention showing three pairs of brackets mounted to a rod and a knob for unlocking a locking mechanism.
Figure 5:
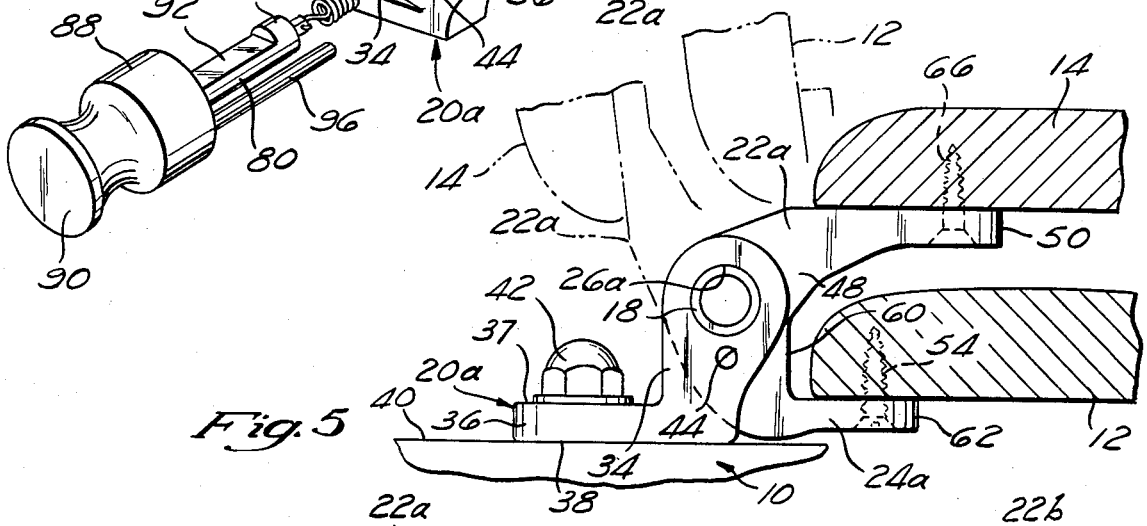
FIG. 5 is a cross-sectional view taken along line 5—5 of FIG. 2 showing the seat cover of FIG. 1 in the closed and locked position in solid lines and in the open unlocked position in phantom lines.

Referring to FIGS. 1 and 5, a toilette 10 has a seat 12 and a seat cover 14 mounted thereon by a locking mechanism 16 to be rotatable between an open position shown in phantom lines in FIG. 5 and a closed position shown in solid lines.

Figure 3:
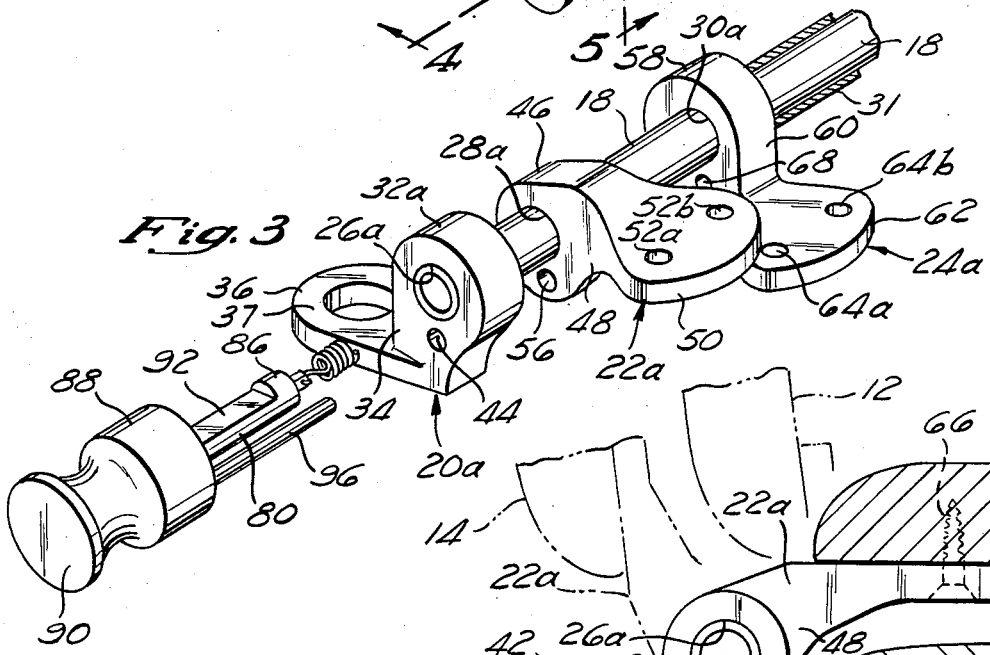
FIG. 3 is a fragmentary exploded perspective view of the toilette seat lock of FIG. 2 showing one bracket of each of the three pairs, a portion of the shaft that mounts the brackets, a knob having a plunger and locking shaft extending therefrom and a spring having one end attached to the plunger.
Figure 4:
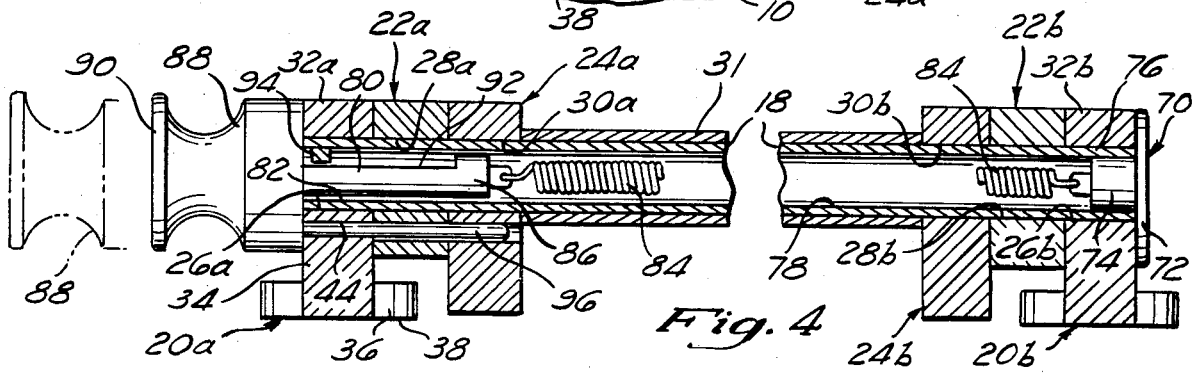
FIG. 4 is a cross-sectional view taken along line 4—4 of FIG. 2 showing the plunger and spring of FIG. 3 inside the rod and showing the locking shaft inside the locking passages in the brackets of FIG. 3 to hold the toilette seat and seat cover of FIG. 1 in the locked position.

Referring to FIGS. 1–5, the locking mechanism 16 includes a hollow rod 18, a pair of mounting brackets **20*a* and 20*b*, a pair of seat cover brackets 22*a* and 22*b* and a pair of seat brackets 24*a* and 24*b*. As best shown in FIGS. 3–5, each of the mounting brackets 20*a*, 20*b* includes a passage 26*a*, 26*b*, respectively, for receiving the rod 18 therein. The mounting bracket 20*a* may be either fixed to the rod 18 or rotatably mounted thereto. In a preferred configuration of the invention, the mounting bracket 20*a* is rotatable upon the rod 18, and the mounting bracket 20*b* is fixed thereto. The seat cover brackets 22*a*, 22*b* include passages 28*a*, 28*b*, respectively for mounting the seat cover brackets 22a, 22b to the rod 18. The seat brackets 24a, 24b include passages 30a, 30b, respectively for mounting the seat cover brackets 24a, 24b to the rod 18. The seat cover brackets 22a, 22b and the seat brackets 24a, 24b are rotatably mounted to the shaft 18 so that the seat and seat cover may be rotated between the open and closed positions shown in FIG. 5**.

A sleeve 31 may be positioned on the rod 18 between the seat cover brackets 22a, 22b to retain them against movement toward one another by a distance less than the length of the sleeve 31. The sleeve 31 aids in fastening the locking device 16 to the toilette 10, the seat 12 and the seat cover 14 by maintaining the brackets in preset convenient positions.

The mounting brackets 20a, 20b include collar portions 32a, 32b in which the passages 26a, 26b are formed. The mounting brackets 20a, 20b have substantially identical structures; therefore, only the mounting bracket 20a is described in detail. The mounting bracket 20a has a projection 34 that extends away from the collar portion 32a radially away from the rod 18. A plate 36 is formed on the end of the projection 34 that faces away from the rod 18. The plate 34 has a pair of generally flat oppositely directed surfaces 37 and 38. When the seat lock 16 is attached to a toilette, the surface 38 faces a planar surface 40 of the toilette 10, and the surface 37 has a fastener, such as a bolt head 42 bearing against it to secure the plate 36 to the toilette 10. The mounting bracket 20a has a locking passage 44 therein. The locking passage 44 is generally parallel to the passage 26a and spaced apart therefrom. The mounting bracket 20b is similar to the mounting bracket 20a except that the mounting bracket 20b does not include a locking passage.

As best shown in FIGS. 3 and 5, the seat cover bracket 22a includes a collar portion 46 in which the passage 28a is formed and a projection 48 that extends from the collar 46 radially away from the rod 18. A plate 50 is formed on the end of the projection that faces away from the rod 18, and a pair of holes 52a, 52b are formed in the plate 50 for receiving fasteners, such as a screw 54, shown in FIG. 5 for securing the seat cover 12 to the seat bracket 22a. A locking passage 56 is formed in the collar portion 46. The locking passage 56 is substantially identical to the locking passage 44. The seat bracket 22b is substantially identical to the seat cover bracket 22a, except that the seat cover bracket 22b does not include a locking passage.

The seat bracket 24a includes a collar 58 in which the passage 30a is formed and a projection 60 that extends from the collar 58 radially away from the rod 18. A plate 62 is formed on the end of the projection that faces away from the rod 18, and a pair of holes are 64a, 64b are formed in the plate 62 for receiving fasteners, such as a screw 66, shown in FIG. 5 for securing the seat cover 14 to the seat bracket 24a. A locking passage 68 is formed in the collar 58. The locking passage 68 is substantially identical to the locking passage 44. The seat bracket 24b is substantially identical to the seat bracket 24a, except that the seat cover bracket 24b does not include a locking passage.

Referring to FIGS. 3 and 4, the locking mechanism 16 includes a plug 70 having an end cap 72 and a projection 74. The projection 74 is press fit into an end 76 of an axial bore 78 in the hollow rod 18. The end cap 72 has a diameter larger than that of the passage 26b to retain the mounting bracket 26b upon the rod 18.

A plunger 80 extends into an end 82 of the axial bore 82, and a biasing device, such as a spring 84, is connected between a inner end 86 of the plunger 80 and projection 74 of the plug 70. An end cap 88 is mounted to an outer end of the plunger 80, and a knob 90 is formed on the end cap 88 for grasping by a person desiring to release the locking mechanism to raise the seat 14 or seat cover 16.

The plunger 80 is retained against rotation inside the axial bore 78 by any conventional means. As shown in FIGS. 3 and 4, the plunger 80 is formed generally as a cylinder with a flattened side portion 92 thereon. The inner end 86 of the plunger 80 is preferably cylindrical and formed to be slidable within the axial bore 78. A projection 94 extends inward in the axial bore 78 above the flattened side portion 92 of the plunger 80 to form a stop to restrict the linear range of motion of the end 86 in the bore. The clearance between the projection 94 and the flattened side portion 92 is sufficient to permit sliding movement of the plunger 80 in the bore 78. However, an attempt to rotate the plunger 80 within the bore 78 engages an edge of the flattened portion 92 with the projection 94, which prevents further rotation of the plunger 80 relative to the rod 18. In practicing the invention, the projection 94 may be formed by crimping an outer sidewall portion of the rod 18.

A locking shaft 96 is fixed to the end cap 88 and extends therefrom generally parallel to the plunger 80. When the seat 12 and seat cover 14 are down as shown in the solid lines in FIG. 5, the locking passages 44, 56 and 68 are aligned as shown in FIG. 4 to receive the locking shaft 96 therein. When the locking shaft 96 penetrates into all of the locking passages 44, 56 and 68, the brackets are retained against rotation relative to the end cap 88, which is also retained against rotation relative to the shaft 18.

Since the mounting bracket 20b is secured to the toilette 10, and the rod 18 is fixed to the mounting bracket 20b, the rod 18 cannot rotate relative to the toilette 10. The plunger 80 also cannot rotate relative to the toilette 10. The locking shaft 92 always has a portion in the locking passage 44 to prevent rotation of the bracket 20a relative to the rod 18. Penetration of the locking shaft 96 into the locking passages 56, 68 prevents rotation of the brackets 22a, 22b, respectively, relative to the plunger 80, which is retained against rotation relative to the toilette 10.

Therefore, engagement of the locking shaft 96 in the passages 44, 56, 68 prevents both seat cover 14 and the seat 12 from being moved to provide access to the inside of the toilette bowl. Since a person must pull out on the knob 90 wiht one hand and lift the seat 12 or the seat cover 14 with the other hand, it is unlikely that the seat or seat cover could be raised by a child so small that he would be likely to be injured if he could raise the seat or seat cover.

The locking shaft 96 must be completely withdrawn from both the passages 56, 68 to permit either the seat cover 14 or both the seat cover 14 and the seat 12 to be raised. The seat cover bracket 22a is between the seat bracket 24a and the mounting bracket 20a, and the seat 12 is under the seat cover 14. Removal of the shaft 96 from only the passage 68 does not permit lifting of the seat 14, since the shaft 96 is still in the passage 56 and the seat cover 14 must be raised in order to raise the seat 12.

What is claimed is:

1. A locking device for retaining a toilete seat and a toilette seat cover in closed postions on a toilette for preventing small children from raising either the seat cover alone or both the seat and seat cover together, comprising:

a mounting bracket connected to the toiette, the mounting bracket having a first locking passage therethrough;

a substantially straight rod rotatably mounted within the mounting bracket, the rod having an axial passage therein, the axial passage being spaced apart from the first locking passage and parallel thereto;

an end cap mounted to an end of the rod;

a plunger mounted to the end cap such that the plunger, the end cap and the locking shaft form a unitary structure, the plunger being positioned to be slidable within the axial passage;

a seat cover bracket rotatably mounted upon the rod, the seat cover bracket including a second locking passage therein;

a seat bracket rotatably mounted upon the rod such that the seat cover bracket is between the mounting bracket and the seat bracket, the seat bracket including a third locking passage therein, the first, second and third locking passages being aligned when the seat and seat cover are in closed positions upon the toilette;

a locking shaft extending from the end cap into the first locking passage and slidable between a first postion in which the locking shaft extends through both the first and second locking passages and through at least a portion of the third locking passage to retain the seat bracket and the seat cover bracket against rotation about the rod to prevent movement of both the seat and the seat cover from their closed positions and a second position in which either the seat cover alone or the seat and cover together may be rotated away from their closed positions;

a spring mounted within the axial passage, the spring having a first end fixed relative to the rod and having a second end connected to the plunger for biasing the plunger toward the interior of the axial passage, a portion of the plunger being slidable out of the axial passage in response to a predetermined force to overcome the bias force of the spring, the locking shaft being withdrawn from the second and third locking passages as the plunger moves out of the axial passage; and a first projection extending radially inward from the rod into the axial passage to form a stop;

a second projection extending radially outward from the plunger for selectively engaging the first projection to limit the range of linear motion of the plunger out of the axial passage;

a planar surface formed on a portion of the plunger, the planar surface facing the first projection, the first projection extending into the axial passage to engage the edges of the planar surface to retain the plunger against rotation relative to the shaft, thereby retaining the locking shaft against rotation out of alignment with the second and third locking passages when the seat and seat cover are in the closed positions.

* * * * *